US010093470B2

(12) United States Patent
Veternik

(10) Patent No.: US 10,093,470 B2
(45) Date of Patent: Oct. 9, 2018

(54) FOOD PACKAGE HAVING OPENING FEATURE AND METHODS OF OPENING THEREOF

(71) Applicant: Intercontinental Great Brands LLC, East Hanover, NJ (US)

(72) Inventor: Paul Veternik, Munich (DE)

(73) Assignee: Intercontinental Great Brands LLC, East Hanover, NJ (US)

( * ) Notice: Subject to any disclaimer, the term of this patent is extended or adjusted under 35 U.S.C. 154(b) by 433 days.

(21) Appl. No.: 14/963,306

(22) Filed: Dec. 9, 2015

(65) Prior Publication Data

US 2017/0166381 A1 Jun. 15, 2017

(51) Int. Cl.
*B65D 75/58* (2006.01)
*B65D 75/20* (2006.01)

(52) U.S. Cl.
CPC ..... *B65D 75/5838* (2013.01); *B65D 75/20* (2013.01); *B65D 75/5833* (2013.01); *B65D 75/5844* (2013.01); *B65D 2575/586* (2013.01)

(58) Field of Classification Search
CPC .... B65B 61/18; B65D 75/20; B65D 75/5838; B65D 2575/586
USPC ..... 53/412, 133.3, 133.4, 133.8; 229/87.05; 383/203, 205
See application file for complete search history.

(56) References Cited

U.S. PATENT DOCUMENTS 3,259,303 A 7/1966 Repko
3,286,832 A * 11/1966 Pilger ..... B65D 75/68 128/DIG. 24
4,210,246 A 7/1980 Kuchenbecker
4,658,963 A * 4/1987 Jud ..... B65D 75/585 229/87.05
4,679,693 A 7/1987 Forman
4,738,365 A 4/1988 Prater
(Continued)

FOREIGN PATENT DOCUMENTS

DE 9003401 5/1990
EP 0432028 A1 * 6/1991 ..... B65B 61/18
(Continued)

OTHER PUBLICATIONS

"Winners of the 19th DuPont Awards for Packaging." DuPont Awards for Packaging Innovation, dated Aug. 11, 2006, 8 pages.
(Continued)

*Primary Examiner* — Stephen F Gerrity
(74) *Attorney, Agent, or Firm* — Fitch, Even, Tabin & Flannery LLP

(57) ABSTRACT

A package is described herein with an opening feature including a flap defined by cut and score lines formed in a film of the package. The flap can be at least partially in a front wall portion of the package to be peeled back and expose an opening to an interior of the package. The flap can also extend across a package such that peeling back of the flap removes a portion of the package. The packages described herein advantageously include a sealed pleat extending across the front wall portion of the package or a fin seal that includes at least a portion of a gripping portion of the flap. The removal of the gripping portion when the flap is peeled back to open the package can expose an adhesive on the inside of the pleat for package reclose.

24 Claims, 9 Drawing Sheets

(56) References Cited

U.S. PATENT DOCUMENTS 5,067,612 A * 11/1991 Tsuchiya et al. .. B65D 75/5844 206/497
5,184,771 A * 2/1993 Jud et al. ..... B65D 75/5844 206/524.2
5,470,015 A * 11/1995 Jud ..... B65D 75/5844 229/87.05
5,622,432 A * 4/1997 Zicker ..... B65D 75/5827 383/120
6,910,995 B2 * 6/2005 Schneider et al. ..... B65D 75/5805 493/213
7,371,008 B2 5/2008 Bonenfant
7,533,773 B2 5/2009 Aldridge
8,114,451 B2 2/2012 Sierra-Gomez
8,142,078 B2 * 3/2012 Matsunaga ..... B65D 75/44 383/107
8,607,980 B2 12/2013 Aldridge
8,763,890 B2 7/2014 Clark
8,814,430 B2 8/2014 Veternik
9,701,454 B2 * 7/2017 Jeon ..... B65D 75/5838
2002/0000441 A1 1/2002 Redmond
2003/0223656 A1 * 12/2003 Razeti et al. ..... B65D 75/20 383/66
2008/0037913 A1 * 2/2008 Martuch ..... B65D 75/5833 383/205
2008/0292224 A1 * 11/2008 Kurosawa et al. .... B65D 33/01 383/120
2010/0147724 A1 6/2010 Mitra-Shah
2011/0253771 A1 10/2011 Willey
2013/0004626 A1 1/2013 Renders et al.
2014/0270597 A1 9/2014 Friedman
2014/0348445 A1 * 11/2014 Siesto Casanova et al. ..... B65D 75/5827 383/99
2015/0016756 A1 1/2015 Down
2015/0021219 A1 1/2015 Oliveira

FOREIGN PATENT DOCUMENTS

EP 1437311 7/2004
EP 1873082 A1 * 1/2008 ..... B65D 75/5838
EP 2360104 8/2011
GB 825616 A * 12/1959 ..... B65B 61/18
WO 8800562 1/1988
WO WO 2009124616 A1 * 10/2009 ..... B65D 75/5838
WO WO 2013092081 A1 * 6/2013 ..... B65D 75/5855

OTHER PUBLICATIONS

International Search Report and Written Opinion, dated Apr. 5, 2017 from corresponding International Application No. PCT/US2016/065123, 17 pages.

* cited by examiner

FOOD PACKAGE HAVING OPENING FEATURE AND METHODS OF OPENING THEREOF

FIELD

This disclosure relates to a food package having an opening feature and, in particular, to food package having an opening feature in the form of an integrated, selectively separable flap.

BACKGROUND

A package, such as a package made of flexible material, is commonly used to store a food product during transportation, storage, and during consumption by a user when multiple servings or multiple food products are disposed in the package. A common type of prior package is mass-produced from a web of film material. The web is formed into a continuous tube by sealing the longitudinal edges of the web together to form a fin seal. This continuous tube can then be singulated into smaller packages by forming transverse seals and cutting transversely across the tube in the region of the transverse seals. The food product may be inserted into the tube after the formation of one of the transverse seals and prior to the formation of the opposite transverse seals for a given individual package. Alternatively, the web may be wrapped around the food product prior to the formation of the fin seal.

Such prior packages can initially store the food product within a sealed interior cavity prior to purchase by a consumer. The consumer can then break one of the transverse seals or remove a corner of the package to access the interior cavity and the food product. Neither of these solutions provides a convenient way for consumers to open the package. Further, uncontrolled opening of the package can result in the package being partially or completely unsuitable for reuse, a disadvantage when the package contains multiple servings or multiple food product intended to be consumed over time.

One issue that arises after the initial breaking is how to effectively reclose the package when the package contains multiple servings or multiple food product intended to be consumed over time. As mentioned above, uncontrolled opening of the package can render it unsuitable for reuse and thus also reclose. If a package is provided without a reclose feature, a common practice is to fold the edges of the package over to reduce the headspace above the food product and close the broken seal. A clip can then be applied over the folded material to hold the package in this closed state. This practice, however, often does not sufficiently close the package and if the consumer does not have a clip, the package can unfold and fully expose the food product.

One type of reclose feature provided in the past was to place a zipper strip along one edge of the package. While generally suitable for providing controlled opening and reclose of the package, the increased cost of the package due to the zipper strip can be undesirable for certain packaging applications.

SUMMARY

A package for a foodstuff is described herein of a film sealed together to define at least a front wall and a rear wall enclosing an interior for receiving a foodstuff. The package includes a pleat of the front wall there of that extends transversely across the front wall. The pleat is formed from first and second wall portions of the front wall that are pivoted together about a fold line and sealed with an adhesive. The package further includes an opening feature formed in the film that includes a flap. The flap is at least partially separable from a remainder of the film along one or more score lines that extend partially through the film to form an access opening to the interior of the package for removal of the foodstuff. The flap also includes a terminal portion that extends into the pleat. The terminal portion of the flap is removable from and reclosable against the adhesive of the pleat to generally reclose the opening feature using the flap after the flap has been separated from the remainder of the film along the score lines.

A lowermost segment of the terminal portion of the flap can further be separated from the remainder of the film by a through cut. The score lines can then intersect ends of the through cut, the ends of the through cut can be disposed on the fold line, the lowermost segment of the terminal portion can project downwardly from the pleat, and the pleat can include an adhesive-free area that aligns with the terminal portion of the flap.

By a further approach, the film of the package can be sealed together along side seals and a bottom seal. The front wall, the rear wall, a top folded edge, the side seals, and the bottom seal enclose the package interior. In this form, the score lines can extend over the top folded edge onto the rear wall portion. The score lines can also have a curvilinear end portion opposite of the through cut.

The pleat can further be folded to extend along a lower portion of the front wall with the second pleat portion underneath the first pleat portion. The second pleat portion and the lower portion of the front wall can then each include laterally outward openings therein that align with one another when the pleat is folded to extend along the lower portion of the front wall. So configured, the first pleat portion can be sealed to the rear wall through the openings.

By one approach, the score lines can extend away from the cut line across a face of the package. The score lines of this form can be configured to extend only partially through the package material so as to allow a hermetic seal to be formed during subsequent package formation. By another approach, the score lines can be disposed within one or more seal zones of a subsequent package so that the adhesive of the seal zones can be used for reclosure. In one example, the score lines can extend away from the cut line within the pleat seal zone until the pleat seal zone and the side seals overlap and then extend upwardly within the side seals. Optionally, the score lines can extend onto a rear face of the package within the side seals. As such, the entire edge of the flap can be resealed against the adhesive of the respective seal zones.

In another form, an opening feature for a food package is described. The food package includes at least a wall. A pleat extends transversely across the wall and includes first and second wall portions. The first and second wall portions can be pivoted together about a fold line and sealed with an adhesive. The opening feature includes a cut through the first wall portion of the pleat and score lines that extend from ends of the cut away from the fold line and longitudinally across at least a portion of the wall. The cut and the score lines form a flap that is disposed at least partially in the wall. The flap is configured to be separated from a remainder of the wall by breaking the score lines to reveal an opening through the wall. The opening feature can further include a terminal portion of the flap that is disposed at least partially in the first wall portion of the pleat. The terminal portion of the flap can then be removable from and reclosable against the adhesive of the pleat to generally reclose the flap over the opening after the flap has been separated from the remainder of the film along the score lines The ends of the through cut can further be disposed on the fold line. By a further approach, the cut can be arcuate, such that a lowermost segment of the terminal portion of the flap projects downwardly from the pleat away from the fold line for grasping by a user.

In a further form, a method is described for opening, removing a food product, and reclosing a reclosable food package using an opening feature. The package, and the opening feature therein, can be in the forms described above. The method can include grasping a tab of a flap of the opening feature formed in the wall, the tab disposed at least partially in the first wall portion of the pleat. By one approach, grasping the tab can include grasping a lowermost portion of the tab that projects past the fold line of the pleat. By another approach, grasping the tab can include grasping an adhesive-free portion of the tab. The tab of the flap can then be pulled to separate the flap from adjacent portions of the wall along a plurality of score lines that extend partially through the wall, including detaching the tab from the first wall portion of the pleat to expose the adhesive, to form an access opening of the food package. Once opened, a food product can be removed from an interior of the food package through the access opening. The tab of the flap can then be reattached to the adhesive of the pleat to reclose the food package.

Another package is described that includes an opening feature with a strip extending across the package. The opening feature can be used, for example, to remove an end portion of the package. The strip can include a tab portion formed in a seal of the package by a cut. Forming the package advantageously causes the tab to project outwardly from and edge of the seal so that it can be easily grasped by a user.

DETAILED DESCRIPTION

Figure 1:
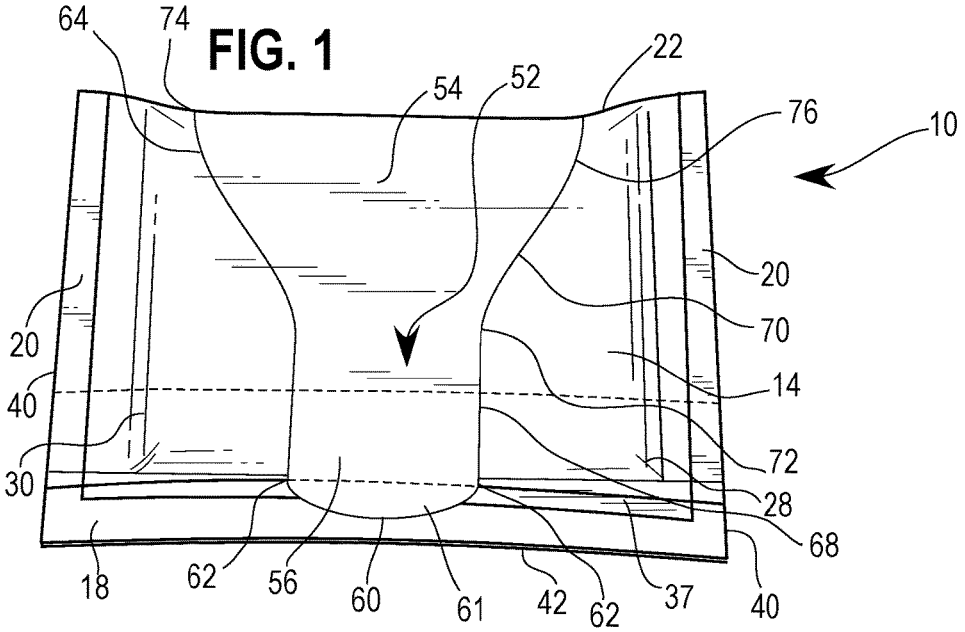
FIG. 1 is a perspective view of a package having a sealed pleat extending thereacross and an opening feature defined therein showing the opening feature in a closed position.

Various embodiments of a food package, blank, and method for controlled opening using an opening feature are described herein and illustrated in FIGS. 1-10.

A package is described herein with a reclosable flap defined by cut and score lines formed in a film of the package. The flap is at least partially in a front wall portion of the package to be peeled back and expose an opening to an interior of the package. The package described herein advantageously includes a sealed pleat extending across the front wall portion of the package that includes at least a portion of a gripping portion of the flap. The removal of the gripping portion when the flap is peeled back to open the package exposes an adhesive on the inside of the pleat for package reclose.

The flap is integral with the package and separable from the remainder of the package in a controlled manner, such as along one or more score or scribed lines extending partially through the package, a through cut, side seams of the package, or combinations thereof. This facilitates opening of the package in a controlled manner with little, if any, deviation from the intended path of opening. As the score lines extend partially, as opposed to completely, through the package, the package integrity is not compromised. Moreover, the pleat can advantageously be sealed off from the interior of the package so that the flap can be at least partially defined by a through cut in the film in the pleat without compromising package integrity.

The package blank is sealed along the outer edges thereof and along a transverse strip intermediate of the ends to create the pleat discussed above. The gripping portion of the flap can extend into these transverse strip and be defined by an end cut, such that when the pleat is folded, an end of the gripping portion defined by the end cut, projects outwardly from the fold for easy grasping by a user.

A first embodiment of a recloseable package 10, as illustrated in FIGS. 1-6, is described herein that is configured to allow a user to repeatedly open and reclose the package 10 while a foodstuff or other package contents is sequentially removed therefrom. The package 10 is created from a web of film 12 that can be singulated from a larger roll of film. The package 10 includes a front wall portion 14 and a rear wall portion 16 bordered by a bottom seal 18, side seals 20, and a top folded edge 22 to create a sealed interior 24 for package contents 26, such as a food product.

A unique feature of the package 10 shown in FIGS. 1-6 is a pleat or folded area 28 that extends transversely across the package front wall 14. The pleat 28 includes top and bottom pleat portions 30, 32 that are sealed together to form the pleat 28. More specifically, the bottom pleat portion 32 is pivoted inwardly about a top fold line 34 separating the top and bottom pleat portions 30, 32 so that the bottom pleat portion 32 extends behind the top pleat portion 30. A bottom fold line 36 separates the bottom pleat portion 32 from a remaining lower portion 37 of the front wall 14 and allows the pleat 28 to lie generally flat on the package front wall 14.

Figure 3:
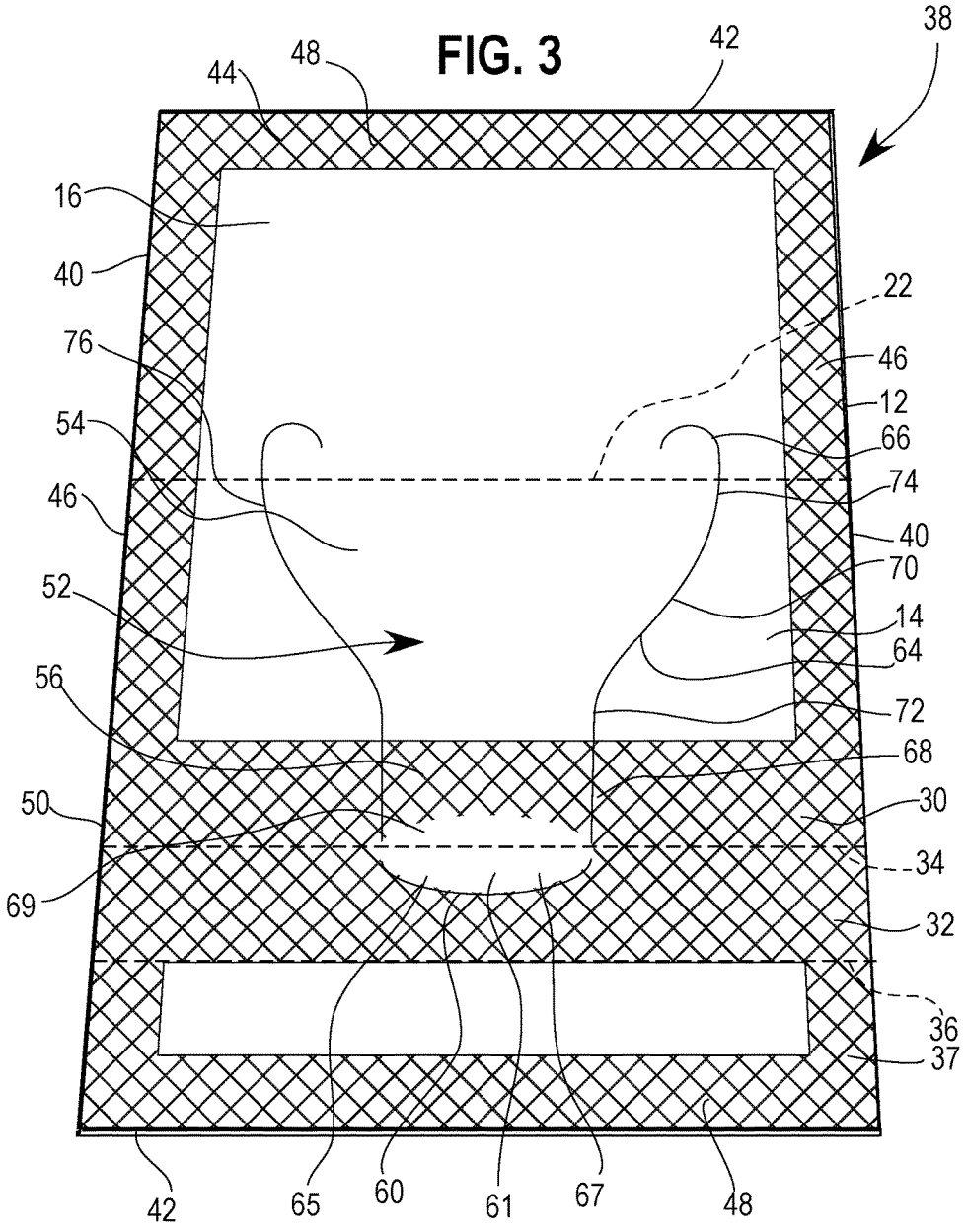
FIG. 3 is a top plan view of a blank for the package of FIG. 1 showing the opening feature and sealing areas.
Figure 4:
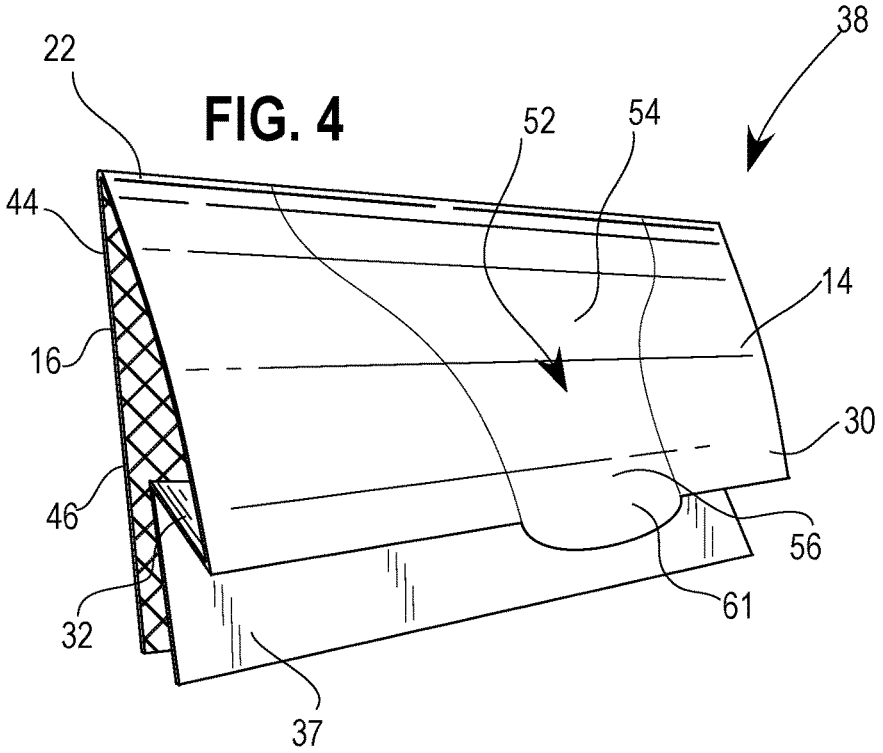
FIG. 4 is a perspective view of the blank of FIG. 3 folded for sealing.

Additional details of the package 10 are shown in FIG. 3, which shows a blank 38 for creating the package 10. The blank 38 includes longitudinal side edges 40 and transverse end edges 42. The blank 38 is shown with sealing areas 44 indicating where the web 12 is sealed during creation of the package 10. The sealing areas 44 include longitudinal edge portions 46 extending along or adjacent to the side edges 40 to create the side seals 20 on the package 10. The sealing areas 44 further include transverse edge portions 48 extending along or adjacent to the end edges 42 to create the bottom seal 18 on the package 10.

As shown in FIG. 3, the sealing areas 44 also include a fold or pleat seal area 50 that extends transversely across the blank 38 intermediate of the transverse edge seal portions 48. The transversely extending top fold line 34 bisects the fold seal area 50 so that the fold seal area 30 can be folded in half to create the pleat 28. The bottom fold line 36 extends transversely across the blank 14 along a bottom of the fold seal area 50 so that the pleat 28 can be folded downwardly to lie adjacent to the package front wall 14.

The package 10 further includes an opening feature 52 formed therein. The opening feature 52 is formed in the web 12 and includes a flap 54 with a terminal portion 56 for gripping by a user. By one approach, the terminal portion can be a gripping tab or portion 56. The flap 54 is configured to be separated from the web 12 and pulled back to reveal an opening 58 to the package interior 24. More specifically, the opening feature 52 is defined by a combination of cut and score lines. A cut 60 is provided entirely within the fold seal area 50 and defines a lowermost portion or tip 61 of the gripping tab 56. Score lines 64 extend from ends 62 of the cut 60 through the top pleat portion 30 and across the remaining portion of the front wall 14. As shown in FIG. 3, the pleat seal area 50 can include an adhesive-free area 65 corresponding to an end portion 67 of the gripping tab 56 so that the end portion 67 of the gripping tab 56 is not tacky when a user grasps it to open the package 10. In the illustrated form, the adhesive-free area 65 includes the lower most portion 61 of the gripping tab 56 as well as a generally mirrored portion 69 on the other side of the top fold line 34. If desired, however, the adhesive-free area 65 can be limited to the lower most portion 61, or can extend further down the gripping tab 56, if desired.

If desired, the score lines 64 can extend through the front wall 14 and onto the rear wall portion 16 over the top folded edge 22. Additionally, ends 66 of the score lines 64 can have tear limiting features, such as the shepherds crook as shown or other suitable features. The cut 60 and the score lines 64 can be formed before creation of the package 10 by any suitable mechanism, including, for example, a laser, a rotary die, or a die.

By one approach, the cut 60 is arcuate and positioned within the fold seal area 50 so that the ends 62 thereof are positioned on or adjacent the top fold line 34. As set forth above, the score lines 64 extend from the ends 62 of the cut 60. In the illustrated form, the score lines 64 include first segments 68 longitudinally extending from the cut ends 62 generally parallel to the side edges 40. The cut 60 and at least portions of the first segments 68 combine to form the gripping tab 56. The first segments 68 extend from the cut 60 for a length of about 3 mm to about 15 mm. In one embodiment, the first segments 68 are generally parallel to one another in the opening direction through the adhesive portion of the fold seal area 50 to provide a secure opening performance that minimizes undesired tearing that deviates from the score lines 64. The score lines 64 further include second segments 70 extending from ends 72 of the first segments 68 opposite the cut ends 62. As shown, the second segments 70 can taper outwardly from each other toward the side edges 40 in order to increase the width of the flap to accommodate the size of the package contents 26. Third segments 74 longitudinally extend from ends 76 of the second segments 70 generally parallel to the side edges 40 and connect to the score line ends 66. The distance between the third segments 74 can be approximately wide enough to facilitate removal of the all of the individual contents 26 in the package 10, or can be close to a width of wider contents to permit removal therethrough. For example, in this latter instance, for a foodstuff that has a width of about 87 mm (about 3.4 inches), the distance between the third segments 74 can be about 85 mm (about 3.35 inches).

As illustrated, the cut 60 and the score lines 64 are configured to preserve package integrity, such as a substantially hermetic seal. The cut 60 is provided within the pleat 28 which is outside of the sealed area of the package 10. The score lines 64 form the remaining portion of the opening feature 52 and do not completely penetrate the web 12, thus preserving the hermetic seal within the package 10.

The score lines 64 can have a depth of between about 20% and about 90%, between about 40% and 80%, between about 60% and about 80%, between about 65% and about 75% and preferably about 70% of the thickness of the package film or laminate. For example, for a laminated package film having a total thickness of about 50 microns (0.0020 inches), comprised in an exemplary embodiment of a transparent or clear orientated polypropylene film with a thickness of about 20 microns (0.0008 inches) and a metalized orientated polypropylene film with a thickness of about 30 microns (0.0012 inches), the score lines 64 can have a depth of about 35 microns (0.0014 inches). In the case of a laminate film, the score lines 64 are preferably in the inner layer, but may also be in the outer layer or extend entirely through one layer and partially into the next layer.

Figure 7:
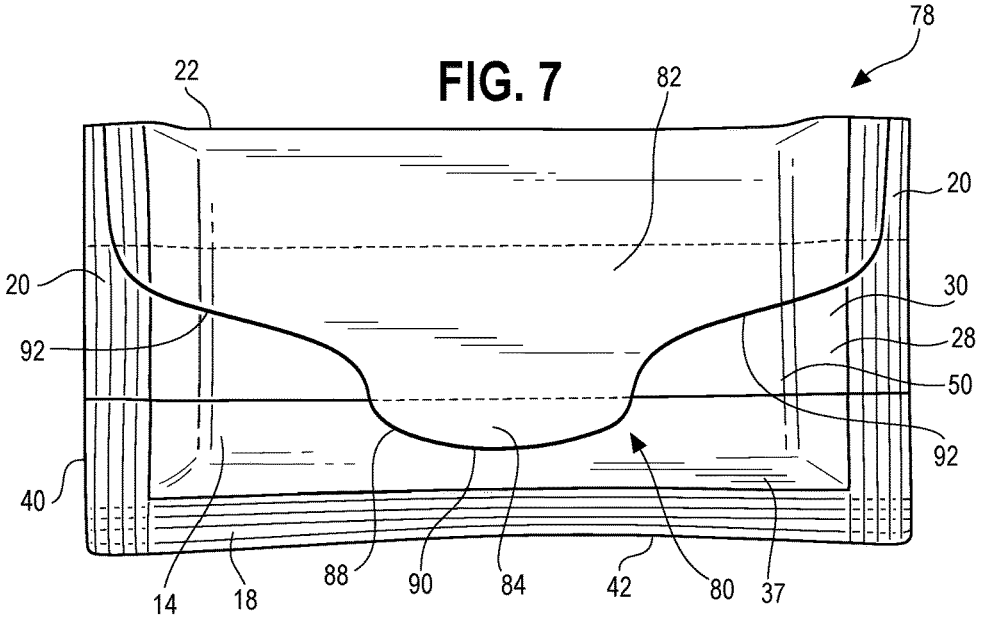
FIG. 7 is a front perspective view of a package having a sealed pleat extending thereacross and an opening feature defined therein showing the opening feature in a closed position.
Figure 8:
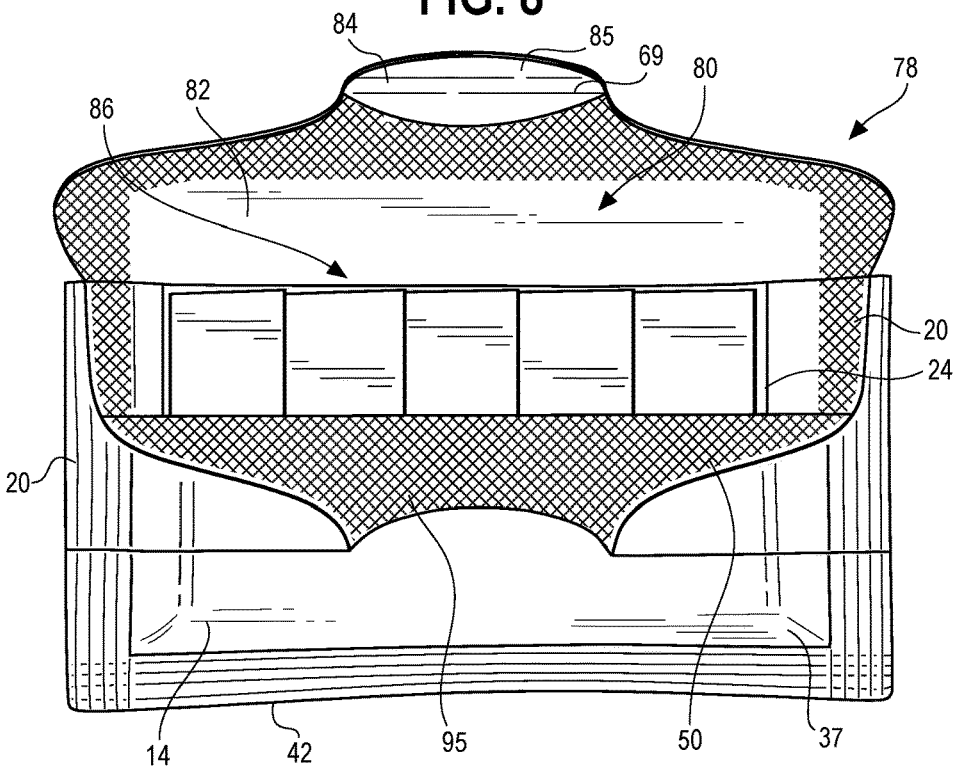
FIG. 8 is a perspective view of the package of FIG. 7 showing the opening feature in an open position.
Figure 9:
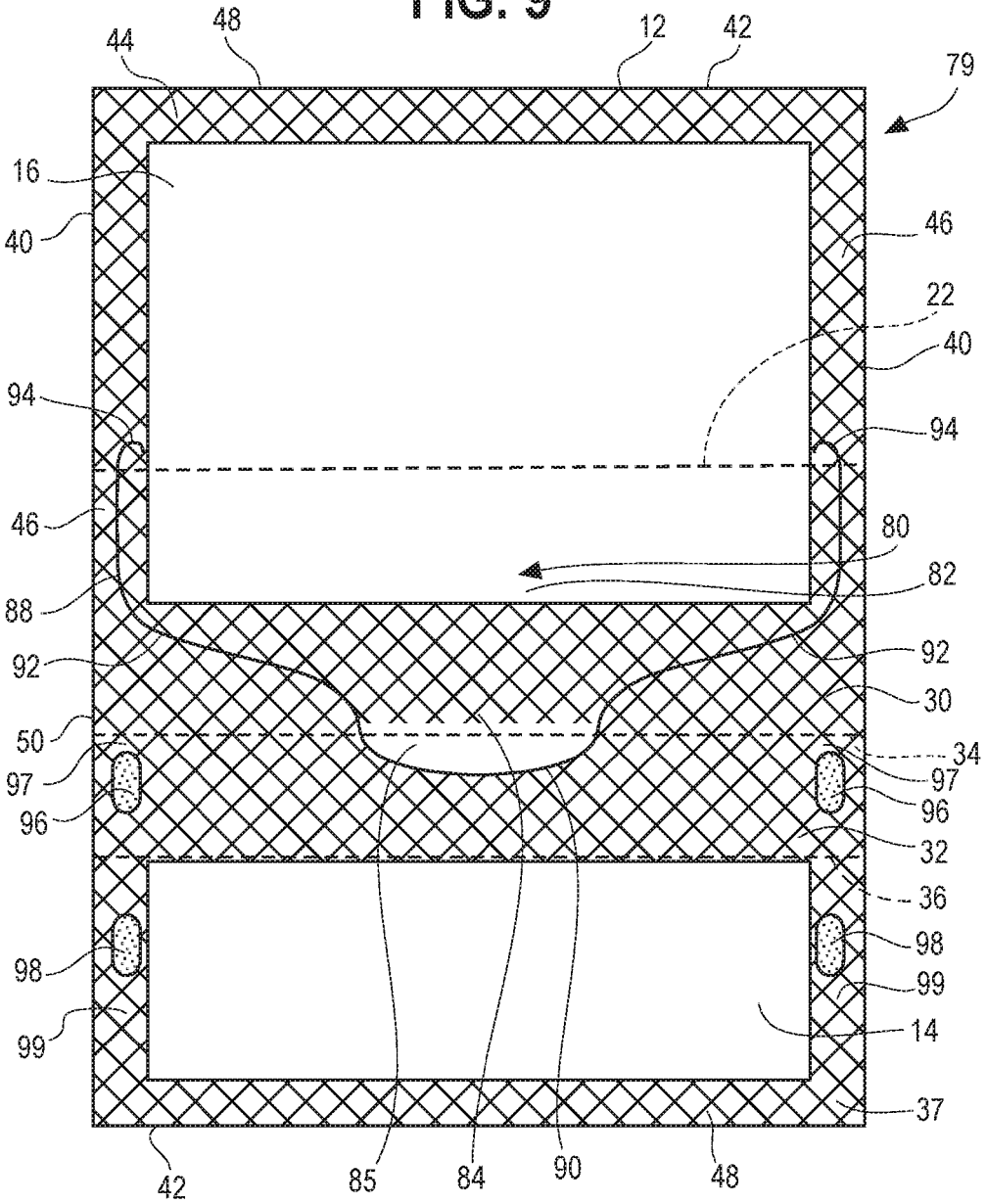
FIG. 9 is a top plan view of a blank for the package of FIG. 1 showing the opening feature and sealing areas.

A second embodiment of a recloseable package 78 created from a blank 79 is shown in FIGS. 7-9 that is configured to allow a user to repeatedly open and reclose the package 78 while a foodstuff or other package contents is sequentially removed therefrom. The package 78 of this embodiment has many similar features and structure to the package 10 described above. As such, the differences will be described herein.

The package 78 of this form provides an opening feature 80 that can be completely resealed against sealing zones of the package exposed during opening. As with the above embodiment, the package includes the pleat or folded area 28 that extends transversely across the package front wall 14.

The opening feature 80 of this form is disposed in the web 12 and includes a flap 82 with a terminal portion 84 for gripping by a user. By one approach, the terminal portion 84 can be a gripping tab or portion. The flap 82 is configured to be separated from adjacent portions of the web 12 and pulled back to reveal an opening 86 to the package interior 24. More specifically, the opening feature 80 is defined by a line or combination of lines 88 in the web 12. The line 88 is provided entirely within the fold seal area 50 and the side seals 20. The line 88 includes a cut 90 that defines a lowermost portion or tip 85 of the gripping tab 84. Score or cut lines 92 extend from ends of the cut 90 across the pleat portion 30 and down the longitudinal seal edge portions 46. As shown, in one embodiment the lines 92 can extend in the opening direction for at least a portion of their length extending from the cut line 90. As discussed above, this provides a secure opening performance that minimizes undesired tearing that deviates from the lines 92. The lines 92 can end prior to the top folded edge 22 or extend all the way thereto. By a further approach, the lines 92 can extend over the top folded edge 22 and onto the rear wall portion 16. Additionally, ends 94 of the lines 92 can have tear limiting features, such as the shepherds crook as shown or other suitable features. As show, the tear limiting features can also be entirely disposed within the side seals 20. The lines 88 can be formed before creation of the package 78 by any suitable mechanism, including, for example, a laser, a rotary die, or a die.

Figure 10:
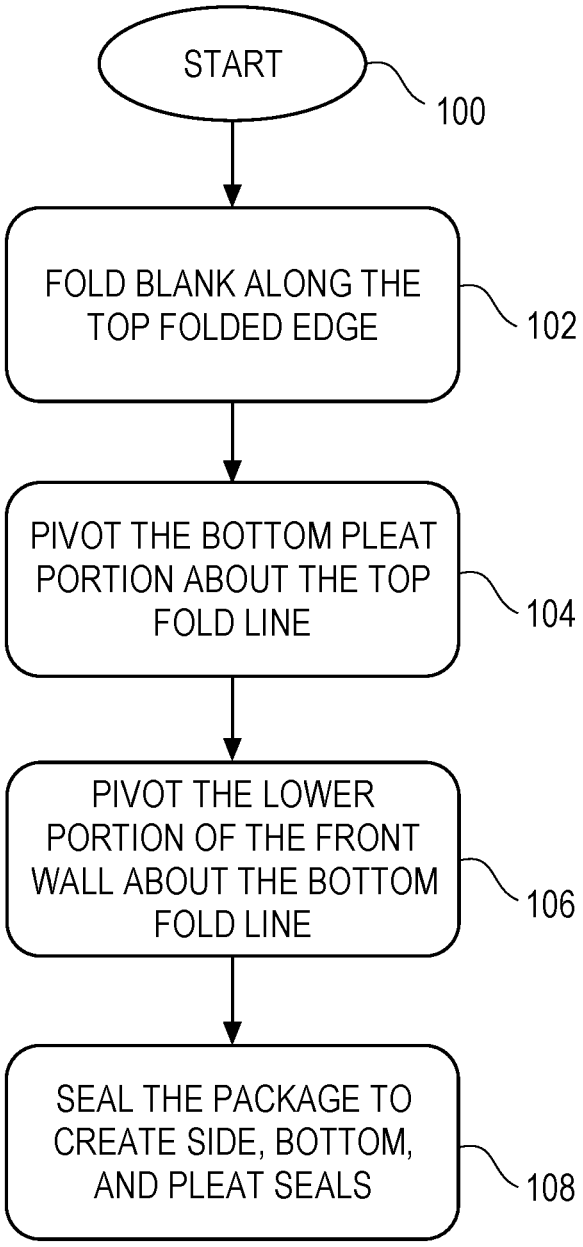
FIG. 10 is a flowchart for forming a package.
Figure 11:
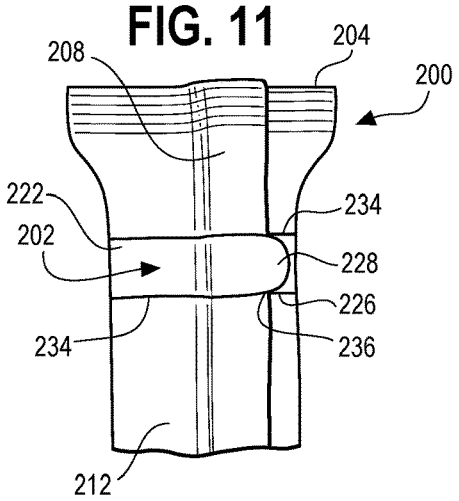
FIG. 11 is a partial perspective view of a package having an opening feature defined therein showing the opening feature in a closed position.
Figure 12:
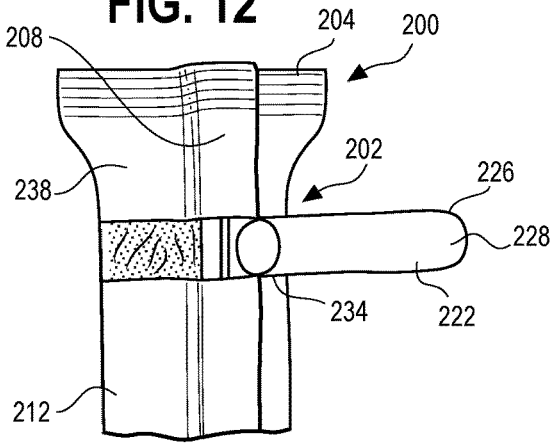
FIG. 12 is a partial perspective view of the package of FIG. 11 showing the opening feature in a partially opened position.

So configured, the package 10, 78 can be created 100 by making a series of folds and seals as illustrated in FIG. 10. More specifically, the blank 38 can be folded 102 along the top folded edge 22 to divide the blank into the front and rear walls 14, 16. The bottom pleat portion 32 can be pivoted 104 about the top fold line 34 so that the bottom pleat portion 32 extends behind the top pleat portion 30. Due to the cut 60, 90, the tip 61, 85 of the gripping tab 56, 84 is no longer attached to the bottom pleat portion 32 and, thus, is not folded therewith. As such, the tip 61, 85 of the gripping tab 56, 84 projects downwardly from the pleat 28 past the top fold line 34 so that it can be easy grasped by a user. The lower portion 37 of the front wall 14 is then pivoted 106 about the bottom fold line 36 so that the lower portion 37 of the front wall 14 extends downwardly from the bottom pleat portion 32 and the transverse end edges 42 of the blank 28 are generally aligned. So assembled, the sealing areas 44 are all aligned and the side, bottom, and pleat seals 20, 22, 28 can be created 108 by any suitable process.

Figure 2:
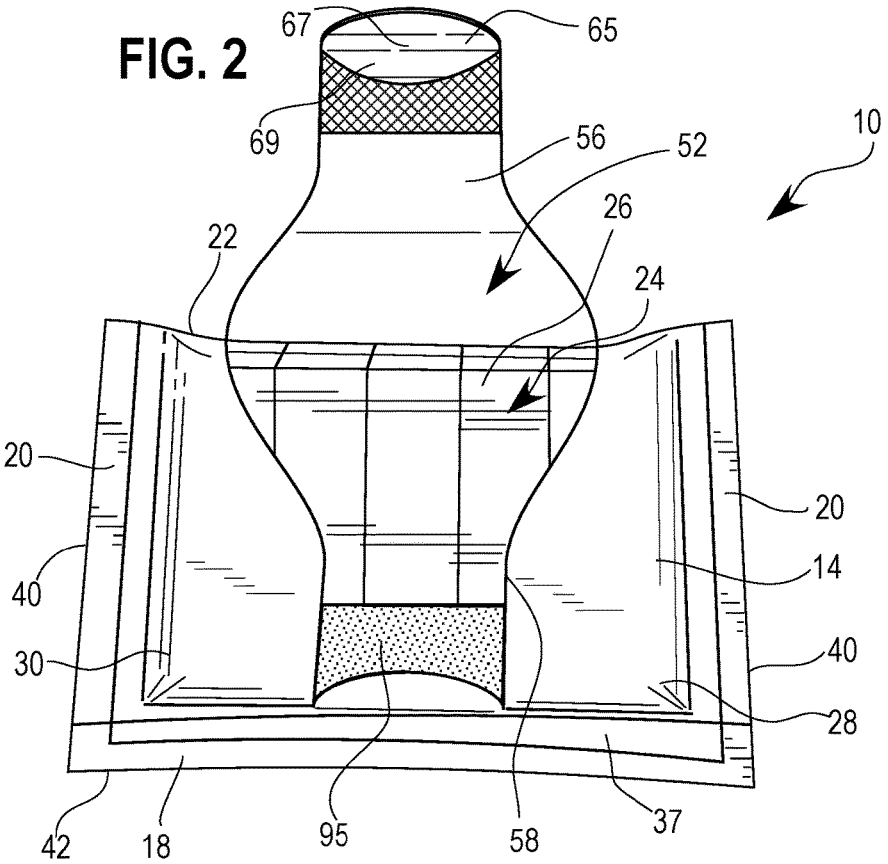
FIG. 2 is a perspective view of the package of FIG. 1 showing the opening feature in an open position.

So formed, the package 10, 78 as shown in FIG. 1 can then be utilized to transport, display, and store the foodstuff 26. Once a portion of the foodstuff 26 is desired, the package 10 can be opened via the opening feature 52, 80 as shown in FIGS. 2 and 8. The tip 61, 85 of the gripping tab 56, 84 can be gripped as it protrudes below the pleat 28. A user then manipulates the gripping tab 56, 84 generally upward and away from pleat 28 and the package front wall 14. As the gripping tab 56, 84 is pulled, a force is exerted to separate the lines 64, 92. With embodiments having score lines, the force is exerted on the score lines 64, 92 at the ends 62 of the cut 60, 90 and the score lines 64, 92 are advantageously designed to break during opening of the package 10, 78. With a sufficient force, the score lines 64, 92 will break and guide the opening of the package 10, 78. As the gripping tab 56, 84 is continually pulled away, the first, second and third portions 68, 70, 72 of the score lines 64, 92 will break pulling the flap 54, 82 away from the package front wall 12. The hooked ends 66, 94 of the score lines 64, 92 stop the tear across the package 10 to provide a controlled opening. In the illustrated form, the hooked ends 66, 94 are provided on the package rear wall 16, so opening the package 10, 78 by pulling the flap 54, 82 reveals the opening 58 to the package interior 24 through the front wall 14 and the top folded edge 22, providing access to the foodstuff 26 from the front and top as desired.

As shown in FIG. 2, after the gripping tab 56, 84 and flap 54, 82 is pulled away from the package front wall 12, a replacement area 95 is revealed in the pleat 28 where the gripping tab 56, 84 was removed therefrom. One or both of the replacement area 95 and the underside of the gripping tab 56, 84 has adhesive thereon from creating the pleat seal 28. The adhesive exposed as a result of opening the package 10, 78 can advantageously be utilized to reclose the package 10, 78 after desired contents 26 have been removed.

Figure 5:
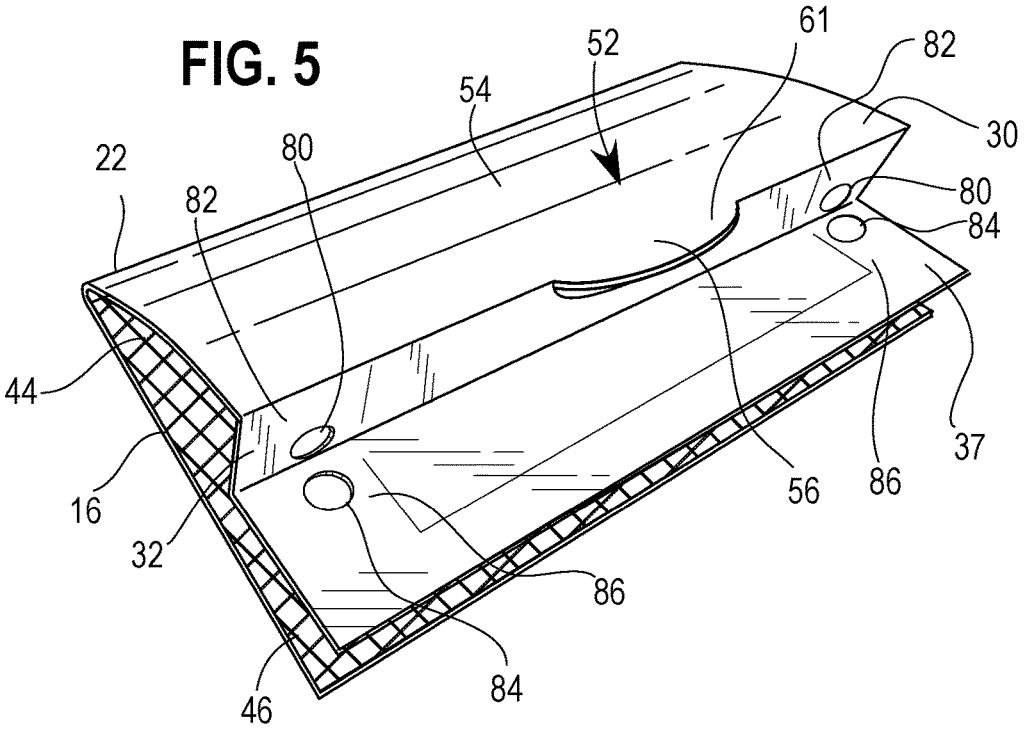
FIG. 5 is a perspective view of a second embodiment of a blank for forming a package.
Figure 6:
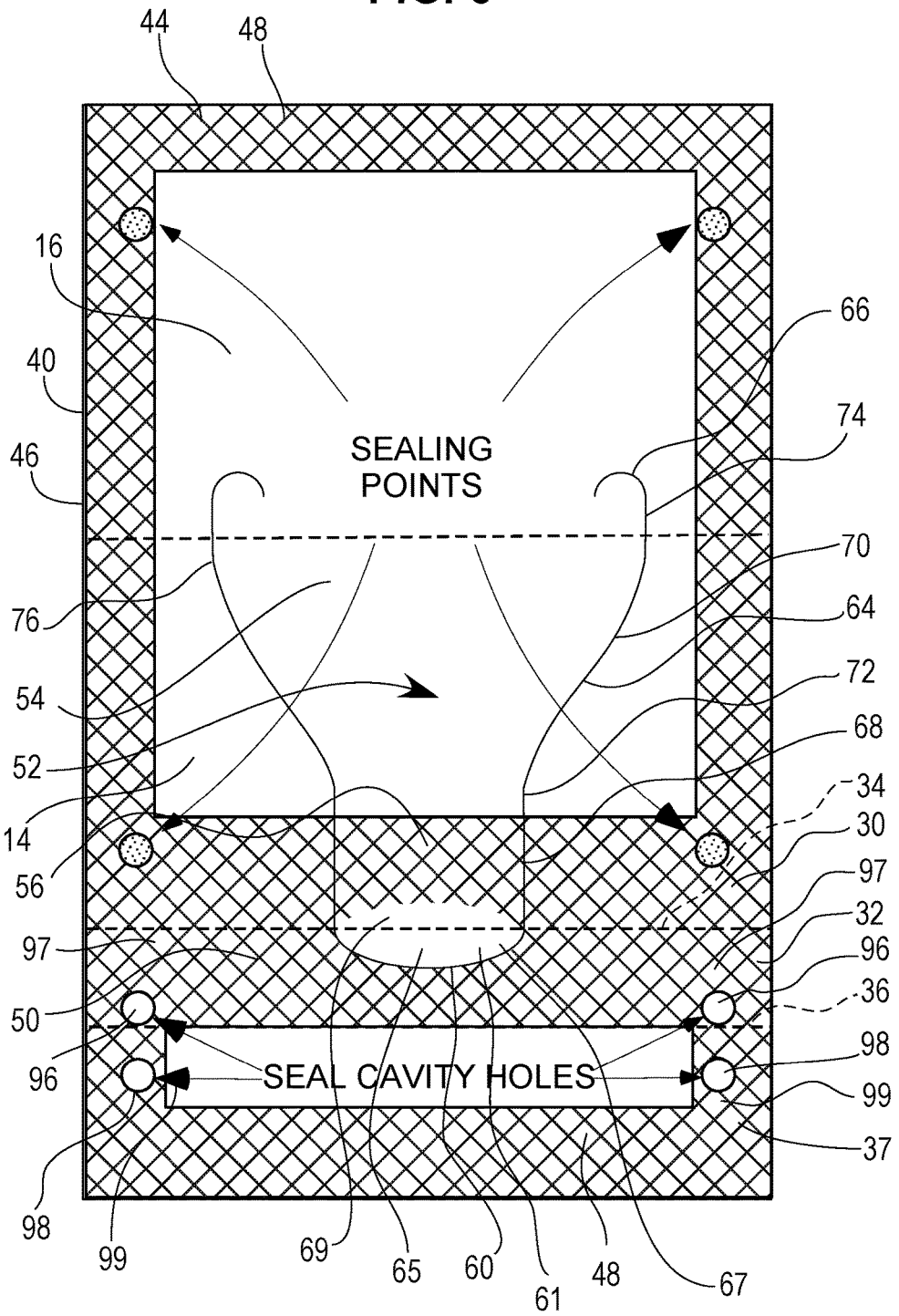
FIG. 6 is a top plan view of the blank of FIG. 5.

The package 10, 78 can also be configured so that the pleat 28 is sealed to the package 10, 78 to resist pivoting away from the package front wall 14. By a first approach, as shown in FIGS. 5 and 6, the blank 28 can include first openings 96 on laterally outer portions 97 of the bottom pleat portion 32 and second openings 98 on laterally outer portions 99 of the remaining lower portion 37 of the front wall 14. The openings 96, 98 are disposed in the blank so that after the package 10, 78 is folded into position for sealing, the openings 96, 98 align. As such, the openings 96, 98 provide a clear path between the top pleat portion 30 and the rear wall 16. Moreover, the laterally outer portions 97, 99 correspond so that the pleat seal 28 is on one side of the openings 96, 98 and the side seal 20 is on the other side of the openings 96, 98. So configured, when the package 10, 78 is sealed, the top pleat portion 30 is sealed to the rear wall 16 and the pleat 28 is restricted from pivoting away from the front wall 14. Alternatively, an adhesive or other suitable seal mechanism can be disposed between the top and bottom pleat portions 30, 32.

Although the embodiments of the packages are shown with a bottom seal 18. The packages as described herein could alternatively have a top seal and a bottom folded edge. By a further approach, the packages described herein could having a fin seal along the rear wall there with top and bottom folded edges.

Another package 200, described herein with reference to FIGS. 11-16, includes an opening feature 202. The package 200 includes a first end seal 204, a second end seal 206, and a longitudinal or fin seal 208 extending therebetween. As such, the package 200 includes a front wall portion 210 and a rear wall portion 212 surrounding a package interior 214 and contents 216 disposed therein.

Figure 15:
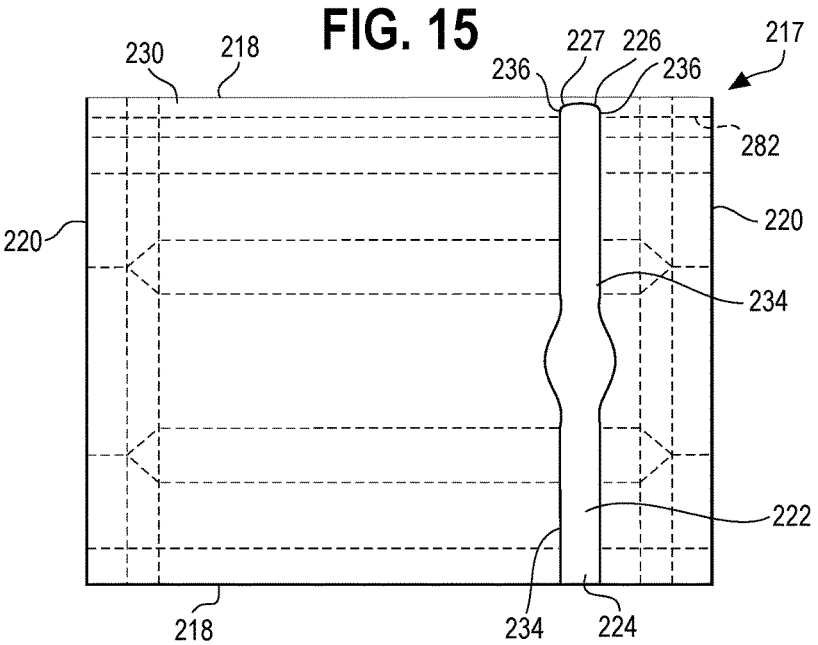
FIG. 15 is a top plan view of a blank for the package of FIG. 11 showing an opening feature defined therein.
Figure 16:
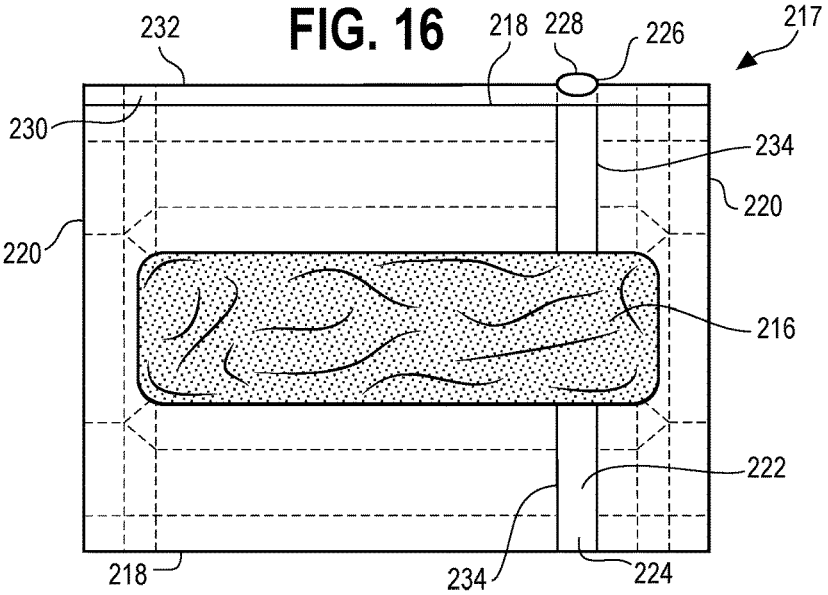
FIG. 16 is a top plan view of the blank of FIG. 15 showing an edge portion folded over so that a tab of the opening feature projects past a package edge.

As shown in FIGS. 15 and 16, the package 200 can be formed from a blank 217. The blank 217 can be a single piece of material or singulated from a web of material as desired. As shown, the blank 217 includes longitudinal side edges 218 and transverse end edges 220. Portions of the blank along the side edges 218 are utilized to form the longitudinal seal 208, while portions of the blank along the end edges are utilized to form the first and second end seals 204, 206.

The opening feature 202 includes a strip 222 that extends transversely across the package 200. As shown, one end 224 of the strip 222 intersects one of the side edges 218 and the other end 226 of the strip 222 is spaced from the other of the side edges 218. The strip 222 is defined by a combination of cut and score lines. The end 226 of the strip 222 spaced from the side edge 218 is defined by a cut 227 that forms a tab 228. During formation of the package 200, a longitudinal edge portion 230 including the blank side edge 218 is folded over a fold line 232. The cut 227 is disposed within the longitudinal edge portion 230, such that when the edge portion 230 is folded over, the tab 228 projects past the fold line 232. If desired, the longitudinal edge portion 230 can be sealed or adhered to the blank 216 after it is folded over. The remaining portion of the strip 222 includes score lines 234 that extend transversely across the blank 216 from ends 236 of the cut 224 to the opposite side edge 218. The score lines 234 can take any desired shape including generally parallel lines, lines having opposing curved portions, curvilinear lines, or the like.

Figure 13:
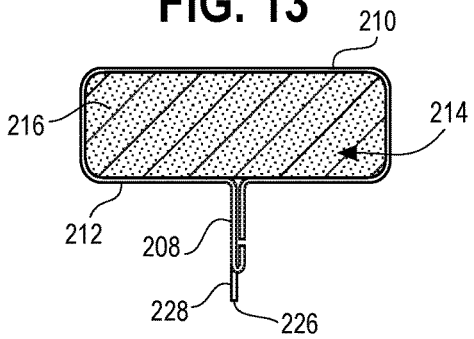
FIG. 13 is a cross-section view of the package of FIG. 11 showing a cut and tab of the opening feature in a fin seal of the package.
Figure 14:
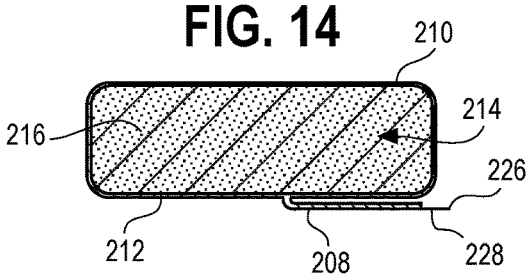
FIG. 14 is a cross-section view of an alternative package showing an opening feature in an off-center fin seal.

Next, the longitudinal seal 208 can be formed. As such, the side edges 218 can be brought generally together. As shown in FIGS. 13 and 14, the fold line 232 forms an outer edge of the longitudinal seal 208 with the longitudinal edge portion 230 folded thereover. The side edges 218 abut or extend adjacent to one another on one side of the longitudinal seal 208. With this configuration, the tab 228 projects outwardly from the longitudinal seal 208 so that it can be easily grasped by a user. The longitudinal seal 208 can be disposed generally centrally along the package rear wall portion 212 as shown in FIG. 13 or offset from center as shown in FIG. 14 so that the tab 228 is aligned with or extending past the package edge.

So configured, when access to the package contents 216 is desired, a user can grasp the tab 228 and peel the strip 222 back. With force, the score lines 234 break along the width of the package 200. As such, the opening feature 202 can be used, for example, to remove an end portion 238 of the package 200.

The drawings and the foregoing descriptions are not intended to represent the only forms of the package in regard to the details of construction. Changes in form and in proportion of parts, as well as the substitution of equivalents, are contemplated as circumstances may suggest or render expedient. For example, although the package is shown with a top folded edge and a bottom seal, the package can alternatively be formed with a bottom folded edge and a top seal. Moreover, the package can be formed with top and bottom folded edges and include a fin or longitudinal seal extending along the rear wall.

The invention claimed is:

1. A package for a foodstuff and having an opening feature, the package comprising:

a film sealed together to define at least a front wall and a rear wall enclosing an interior for receiving a foodstuff;

a pleat of the front wall extending transversely thereacross, the pleat comprising first and second wall portions of the front wall pivoted together about a fold line and sealed with an adhesive therein;

an opening feature formed in the film and including a flap, the flap being at least partially separable from a remainder of the film along one or more score lines extending partially through the film to form an access opening to the interior for removal of the foodstuff; and a terminal portion of the flap extending into the pleat, the terminal portion of the flap being removable from and reclosable against the adhesive of the pleat to generally reclose the opening feature using the flap after the flap has been separated from the remainder of the film along the score lines.

2. The package of claim 1, wherein at least a lowermost segment of the terminal portion of the flap is separated from the remainder of the film by a through cut.

3. The package of claim 2, wherein the flap is separable from the film along a pair of score lines, each of the pair of score lines intersecting ends of the through cut.

4. The package of claim 3, wherein the ends of the through cut are disposed on the fold line.

5. The package of claim 4, wherein the lowermost segment of the terminal portion of the flap projects downwardly from the pleat for gasping by a user.

6. The package of claim 2, wherein the pleat includes an adhesive-free area that aligns with at least a portion of the terminal portion of the flap.

7. The package of claim 1, wherein the film is sealed together along side seals and a bottom seal that, together with the front and rear wall and a top folded edge, enclose the interior.

8. The package of claim 7, wherein the score lines extend over the top folded edge onto the rear wall portion.

9. The package of claim 7, wherein the pair of score lines each have a curvilinear end portion, opposite their intersection with the through cut.

10. The package of claim 7, wherein the pleat is folded to extend along a lower portion of the front wall with the second pleat portion underneath the first pleat portion, and the second pleat portion and the lower portion of the front wall each include laterally outward openings therein that align with one another with the pleat folded to extend along the lower portion such that the first pleat portion is sealed to the rear wall through the openings.

11. The package of claim 7, wherein the score lines extend outwardly within the pleat and upwardly within the side seals such that the flap is recloseable against the adhesive of the pleat and the adhesive of the side seals.

12. The package of claim 1, wherein the score lines extend at least partially across the front wall of the package spaced from seals of the film.

13. The package of claim 1, wherein the score lines have segments that diverge from each other.

14. An opening feature for a food package having a wall, the opening feature comprising:

a pleat extending transversely across the wall, the pleat comprising first and second wall portions pivoted together about a fold line and sealed with an adhesive;

a cut through the first wall portion of the pleat;

score lines extending from ends of the cut away from the fold line and longitudinally across at least a portion of the wall;

a flap formed at least in part in the wall by the cut and the score lines, the flap configured to be separated from a remainder of the wall by breaking the score lines to reveal an opening through the wall; and a terminal portion of the flap disposed at least partially in the first wall portion of the pleat, the terminal portion of the flap being removable from and reclosable against the adhesive of the pleat to generally reclose the flap over the opening after the flap has been separated from the remainder of the film along the score lines.

15. The package of claim 14, wherein the ends of the through cut are disposed on the fold line.

16. The package of claim 15, wherein the cut is arcuate and defines a lowermost segment of the terminal portion of the flap that projects downwardly from the pleat away from the fold line for gasping by a user.

17. The package of claim 14, wherein the pleat includes an adhesive-free area that aligns with at least a portion of the terminal portion of the flap.

18. The package of claim 14, wherein the score lines each have a curvilinear end portion opposite ends of the cut.

19. The package of claim 14, wherein the score lines have segments that diverge from each other.

20. The package of claim 14, wherein the score lines extend from the ends of the cut outwardly within the pleat and longitudinally within side seals of the food package such that the flap is recloseable against the adhesive of the pleat and adhesive of the side seals.

21. A method of opening, removing a food product, and reclosing a reclosable food package using an opening feature, the food package having a pleat comprising first and second wall portions pivoted together about a fold line and sealed with an adhesive that extends transversely across a wall of the food package, the method comprising:

grasping a tab of a flap of the opening feature formed in the wall, the tab disposed at least partially in the first wall portion of the pleat;

pulling the tab of the flap to separate the flap from adjacent portions of the wall along a plurality of score lines extending partially through the wall, including detaching the tab from the first wall portion of the pleat to expose the adhesive, to form an access opening of the food package;

removing a food product from an interior of the food package through the access opening; and reattaching the tab of the flap to the adhesive of the pleat to reclose the food package.

22. The method of claim 21, wherein grasping the tab comprises grasping a lowermost portion of the tab that projects past the fold line of the pleat.

23. The method of claim 21, wherein grasping the tab comprises grasping an adhesive-free portion of the tab.

24. The method of claim 21, wherein:

the food package further includes side seals sealed with an adhesive and the score lines extend outwardly within the first wall portion of the pleat and longitudinally within the side seals, pulling the tab of the flap to separate the flap from adjacent portions of the wall along the plurality of score lines includes detaching the flap from the side seals to expose the adhesive extending partially through the wall, including detaching the tab from the first wall portion of the pleat to expose the adhesive, to form an access opening of the food package; and reattaching the tab of the flap to the adhesive of the pleat to reclose the food package further comprises reattaching the flap to the adhesive of the side seals.

* * * * *